US005840455A

United States Patent [19]

Ikuno et al.

[11] Patent Number: 5,840,455

[45] **Date of Patent: *Nov. 24, 1998**

[54] ELECTROPHOTOGRAPHIC PHOTOCONDUCTOR

[75] Inventors: Hiroshi Ikuno; Narihito Kojima; Hiroshi Nagame, all of Numazu, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2). The term of this patent shall not extend beyond the expiration date of Pat. No. 5,525,477.

[21] Appl. No.: 653,387

[22] Filed: May 24, 1996

[30] Foreign Application Priority Data

May 24, 1995 [JP] Japan ..... 7-149502

[51] Int. Cl.[6] ..... G03G 15/04

[52] U.S. Cl. ..... 430/67; 430/66

[58] Field of Search ..... 430/67, 66

[56] References Cited

U.S. PATENT DOCUMENTS 5,059,502 10/1991 Kojima et al. ..... 430/66

5,168,023 12/1992 Mitani et al. ..... 430/58

5,452,061 9/1995 Kojima et al. ..... 355/219

5,525,447 6/1996 Ikuno et al. ..... 430/67

*Primary Examiner*—Mark Chapman

*Attorney, Agent, or Firm*—Oblon, Spivak, McClelland, Maier Neustadt, P.C.

[57] ABSTRACT

An electrophotographic photoconductor, having a conductive supporting substrate, a photoconductive layer disposed thereon, and a surface protective layer formed on the photoconductive layer, with the surface protective layer being made of hydrogenated diamond-like carbon or hydrogenated amorphous carbon and containing at least one additional element selected from the group consisting of nitrogen, fluorine, boron, phosphorus, chlorine, bromine and iodine, with the atomic ratio of total additional elements to carbon in the surface protective layer being smaller in close proximity to the photoconductive layer than in the remainder of the surface protective layer, and having a Knoop hardness of more than or equal to 1000 kg/mm$^2$ in the outermost portion of the surface protective layer is provided which has improved resistance against peeling and scratch, and is thus capable of forming electrophotographic images of high quality for repeated use over an extended period of time.

18 Claims, 4 Drawing Sheets

ELECTROPHOTOGRAPHIC PHOTOCONDUCTOR

BACKGROUND OF THE INVENTION

1. Field of the Invention

The present invention relates to an electrophotographic photoconductor having a surface protective layer made of a hydrogenated carbon composition formed on a photoconductive layer to attain improved peeling and scratch resistance and improved durability in forming high quality electrophotographic images.

2. Discussion of the Background

Electrophotographic imaging systems are well known. Generally, a photoreceptive or photoconductor material is used, on which is formed an electrostatic latent image. This photoreceptor is made of an electrically conductive supporting substrate and contains on its surface a layer of a photoconductive material.

Examples of known useful photoconductive materials include selenium or alloys of selenium, an inorganic photoconductive material, such as zinc oxide or cadmium sulfide, dispersed in a binder agent, and amorphous silicon and alloys of silicon. Other conventional photoconductive materials include various organic materials such as poly-N-vinyl carbazole in combination with trinitrofluorenone or an azo pigment.

In electrophotography the surface of the photoconductive layer is initially charged in the dark with an electrostatic charge of a first polarity such as by corona charging. The surface is then exposed to light to selectively dissipate the charge from the exposed areas and form electrostatic latent images. Subsequently, these latent images are developed into visible images with toner particles made of a coloring agent, such as a dye or pigment, and a binder agent.

It is required for an electrophotographic photoconductor to have the following fundamental characteristics: (1) to be chargeable to an appropriate electric potential in the dark, (2) to be capable of a reduced charge dissipation in the dark, and (3) to exhibit a rapid charge dissipation from light exposed areas on the photoconductive layer.

In accordance with the recent development of high speed and large size electrophotographic copying machines, there continues to be a need to add to the above list a requirement for photoconductors to be capable of forming images of high quality with sufficient durability for repeated use for an extended period of time.

Degradation in the durability of the electrophotographic performance of the photoconductor is generally attributed to two main factors. The first factor is abrasion and/or scratch induced by mechanical stress during processes such as image developing, residual toner particles cleaning, and copysheet transfer. The second factor is chemical damage or alteration induced by a corona charge during processes such as charging, image transfer and/or copysheet separation.

In order to overcome the first factor, it is known to provide a protective layer disposed on the photoconductive layer. As examples of the protective layer disposed on a photoconductive layer, there are disclosed an organic layer (Japanese Pat. No. 38-15466), an inorganic layer (Japanese Pat. No. 43-14517), an insulator layer with an undercoated adhesive layer (Japanese Pat. No. 4327591) and a stratified layer having, in order stated from the bottom, a layer of amorphous Si, a layer of hydrogenated amorphous Si containing nitrogen and a layer of hydrogenated amorphous Si containing oxygen, each deposited by means of plasma CVD or photo CVD (Japanese Laid-Open Pat. Applications Nos. 57-179859 and 59-58437).

Additionally, recent development in techniques for deposition of high hardness films have prompted various attempts to use these films as protective layers for an electrophotographic photoconductor. These films are made of carbon containing hydrogen, and are referred to as, for example, hydrogenated amorphous carbon films, non-crystalline or amorphous carbon film, or diamond-like carbon film. These films are formed by various deposition methods, such as plasma CVD or photo CVD, or sputtering.

As conventional examples of the hydrogenated carbon films, there are disclosed a protective layer of non-crystalline or high hardness carbon disposed on the surface of a photoconductor layer (Japanese Laid-open Pat. Application No. 60-2491155), a protective layer of diamond-like carbon provided on an outermost face of a photoconductor layer (Japanese Laid-open Pat. Application No. 61-255352), a high-hardness insulator layer, comprising carbon as a main component, on a photoconductor layer (Japanese Laid-Open Pat. Application No.61-264355) and an organic photoconductor layer having provided thereon a protective layer of hydrogenated non-crystalline carbon, further containing nitrogen, oxygen, halogen or alkali metal, formed by a glow discharge method (Japanese Laid-Open Pat. Applications Nos. 63-220166-9).

These conventional examples provide photoconductor layers with significantly improved surface hardness and excellent abrasion resistance. However, the thus obtained protective layers do not acquire sufficient resistance against peeling from and/or cracking on the surface of the photoconductive layers, caused by prolonged mechanical stress exerted locally on the protective layer.

In order to improve the durability and humidity resistance, thereby preventing the fogging of electrophotographic images formed, a photoconductor has been proposed that comprises a photoconductive layer having a surface protective layer disposed thereon, when the surface protective layer is made of an amorphous hydrocarbon film containing fluorine with its concentration increased in the direction of the thickness of the surface protective layer towards the photoconductive layer (Japanese Laid-open Pat. Application No. H1-227161). However, the peeling resistance of the protective layer of this photoconductor was still insufficient from a practical point of view.

There has also been proposed a surface protective layer, disposed on a photoconductive layer, where the protective layer comprises hydrogenated diamond-like carbon, containing additional elements selected from the group of the elements consisting of nitrogen, fluorine, boron, phosphorus, chlorine, bromine and iodine, where the ratio of the total of the additional elements to carbon is higher in close proximity to the outermost layer than in close proximity to the photoconductive layer (Japanese Pat. Application No. H6-266240).

A three layer surface protective layer has also been disclosed that comprises a first layer disposed on a photoconductive layer and a third or outermost layer, both made of carbon as a major component with additional elements such as hydrogen and oxygen; and a second layer, disposed between the first and the third layer, made of carbon as a major component with additional atoms, such as, hydrogen, oxygen, and nitrogen (Japanese Pat. Application No. H6-303090). Although these two photoconductors are found to possess improved peeling resistance, the photoconductors still do not exhibit satisfactory anti-scratch characteristics.

SUMMARY OF THE INVENTION

Accordingly, one object of the present invention is to provide an electrophotographic photoconductor which overcomes the above-noted difficulties.

A further object of the present invention is to provide an electrophotographic photoconductor, comprising a photoconductive layer and a surface protective layer comprising carbon disposed on the photoconductive layer, which exhibits excellent peeling and scratch resistance, thereby capable of forming electrophotographic images of high quality for repeated use for an extended period of time.

These and other objects of the present invention have been satisfied by the discovery of an electrophotographic photoconductor, comprising a conductive supporting substrate, a photoconductive layer disposed thereon, and a surface protective layer formed on the photoconductive layer, wherein the surface protective layer comprises a hydrogenated diamond-like carbon or hydrogenated amorphous carbon, and contains at least one additional element selected from the group consisting of nitrogen, fluorine, boron, phosphorus, chlorine, bromine and iodine, such that the total of additional elements is present in a gradient from low concentration to high concentration of the additional elements as one moves away from the photoconductive layer, and having a Knoop hardness of greater than or equal to 1000 kg/mm$^2$ in the outermost portion of the surface protection layer.

According to an alternative embodiment, the surface protective layer comprises a hydrogenated diamond-like carbon structure or hydrogenated amorphous carbon and contains nitrogen, wherein the atomic ratio of nitrogen to carbon, the N/C ratio, in the surface protective layer is less than or equal to 0.005 in close proximity (at the layer to layer interface) to the photoconductive layer.

In another embodiment, the surface protective layer comprises a hydrogenated diamond-like carbon structure or hydrogenated amorphous carbon, and contains nitrogen and fluorine, wherein the atomic ratio of fluorine to carbon, the F/C ratio, in the surface protective layer is less than or equal to 0.001 in close proximity (at the layer to layer interface) to the photoconductive layer.

In yet another embodiment, the surface protective layer formed on the photoconductive layer has a thickness of from 1 to 3 microns.

These and other objects, features and advantages of the present invention will become apparent upon a consideration of the following description of the preferred embodiments of the present invention taken in conjunction with the accompanying drawings.

DESCRIPTION OF THE PREFERRED EMBODIMENTS

Figure 1:
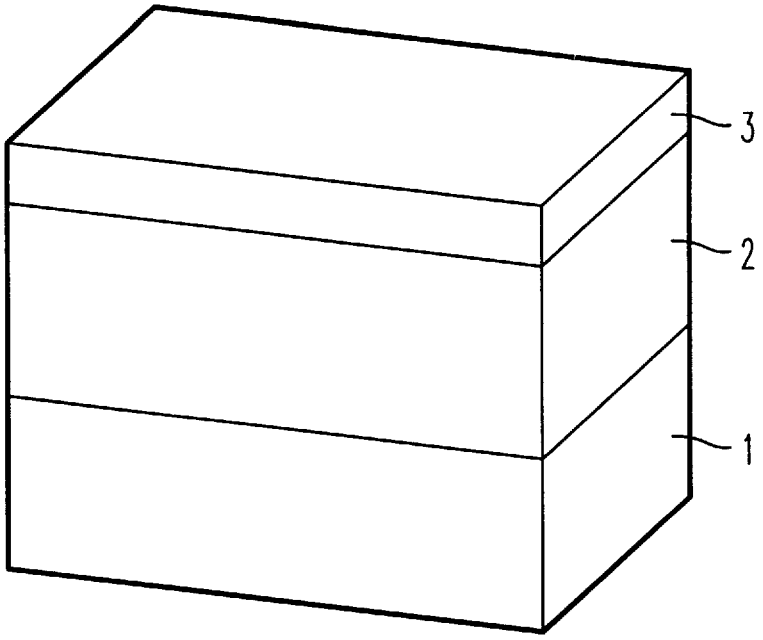
FIGS. 1–4 are partially schematic cross-sectional views of the electrophotographic photoconductors of the present invention.

In the detailed description which follows, specific embodiments of the present invention particularly useful in electrophotographic applications are described. It is to be understood, however, that the invention is not limited to these embodiments. For example, it is appreciated that the photoconductors and methods of the present invention are adaptable to any form of electrophotographic imaging. Other embodiments will be apparent to those skilled in the art upon reading the following description.

The present invention provides an electrophotographic photoconductor, comprising a photoconductive layer disposed on a conductive supporting substrate, and a surface protective layer formed on the photoconductive layer. In the present invention, the surface protection layer comprises a hydrogenated diamond-like carbon or hydrogenated amorphous carbon, and further comprises at least one additional element selected from the group consisting of nitrogen, fluorine, boron, phosphorus, chlorine, bromine and boron, such that the total of the additional elements is present in a gradient from low concentration to high concentration of additional elements as one moves away from the photoconductive layer. This gradient from low concentration to high concentration is not required to a continual increase throughout the protective layer and can actually be an increase stepwise at various layer thicknesses. The primary requirement is that the concentration adjacent to the photoconductive layer must be lower than in the remainder of the protective layer. In the context of the present invention, the concentration of additional elements is designated by the atomic ratio of total additional elements to carbon in the surface protective layer. Thus the atomic ratio of additional elements to carbon is smaller adjacent to the photoconductive layer and increases as one moves through the protective layer away from the photoconductive layer. The surface protective layer of the present invention is also required to have a Knoop hardness of more than or equal to 1000 kg/mm$^2$ in the outermost portion of the surface protective layer.

The thus formed electrophotographic photoconductor having the present surface protective layer provides improved peeling and scratch resistance, and is capable of forming images of high quality for repeated use over an extended period of time.

While not wishing to be bound by any particular theory on the mechanism of action of the present photoconductors, the improvements seen using the photoconductors of the present invention are believed to be due to the following reasons: By the inclusion of the additional element(s), such as nitrogen, fluorine, boron, phosphorus, chlorine, bromine or iodine, the surface protective layer in general acquires lower electric resistivity and higher light transparency, resulting in improvement in the image forming characteristics. When this layer alone is disposed on the photoconductive layer, however, undesirable properties result, such as a higher residual potential and reduced layer adhesion after repeated copysheet transfer for an extended period of time, due to damage induced in the photoconductor layer during etching by gaseous species of the additional elements, such as $NH_3$, $N_2$, $C_2F_6$, $CH_3F$, $B_2H_6$, $PH_3$, $CH_3Cl$, $CH_2Cl_2$, $CHCl_3$, CHCl, $CCl_4$, $CH_3Br$, $CH_3I$, $NF_3$, $BCl_3$, $BBr_3$, $BF_3$, $PF_3$, $PCl_3$, etc.

In order to prevent such damage, the present invention provides a protective layer. The protective layer initially is formed under a decreased amount of the gaseous species of the additional elements up to a predetermined thickness, and subsequently with an increased amount of the gaseous species, resulting in a protective layer with reduced damage and thereby improved imaging capability. Moreover, by additionally providing an outermost layer having a Knoop hardness of more than or equal to 1000 kg/mm$^2$, an improved anti-abrasion and anti-scratch property is obtained in addition to the above-noted excellent characteristics. Furthermore, when nitrogen and/or fluorine are included in the surface protective layer and the amount of nitrogen and/or fluorine in the layer is controlled to have a specified atomic ratio of N and/or F to carbon in close proximity to the photoconductive layer different from the ratio in the other portions in the layer, and the thickness of the surface protective layer is also controlled, the above-noted properties of the surface protective layer are further improved. The term "close proximity", within the context of the present invention, refers to the portion of the protective layer adjacent to the photoconductive layer, at and adjacent to the layer-layer interface.

Referring to the drawings, the invention will be described.

Illustrated in FIG. 1 is a partial cross sectional view of an electrophotographic photoconductor of the present invention, comprising a conductive supporting substrate 1, a photoconductive layer 2 disposed thereon, and a surface protective layer 3 disposed on the photoconductive layer.

Figure 2:
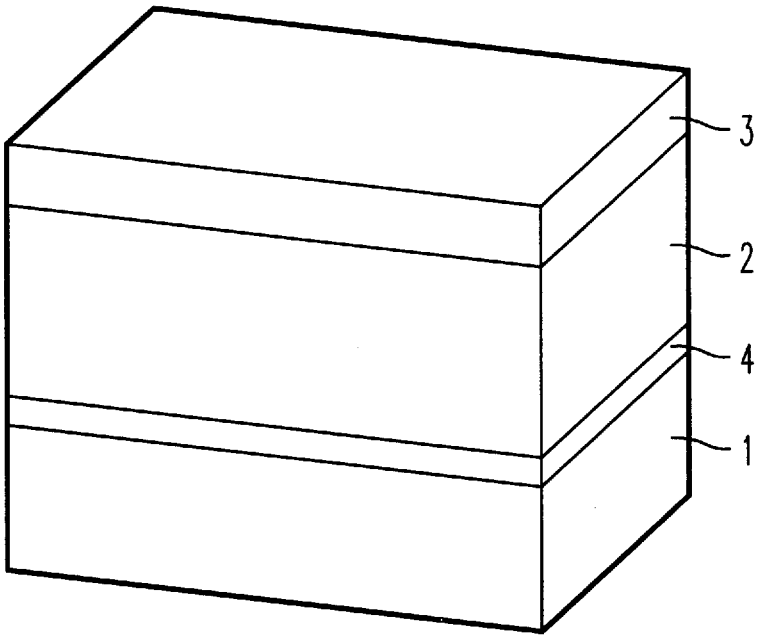
Figure 3:
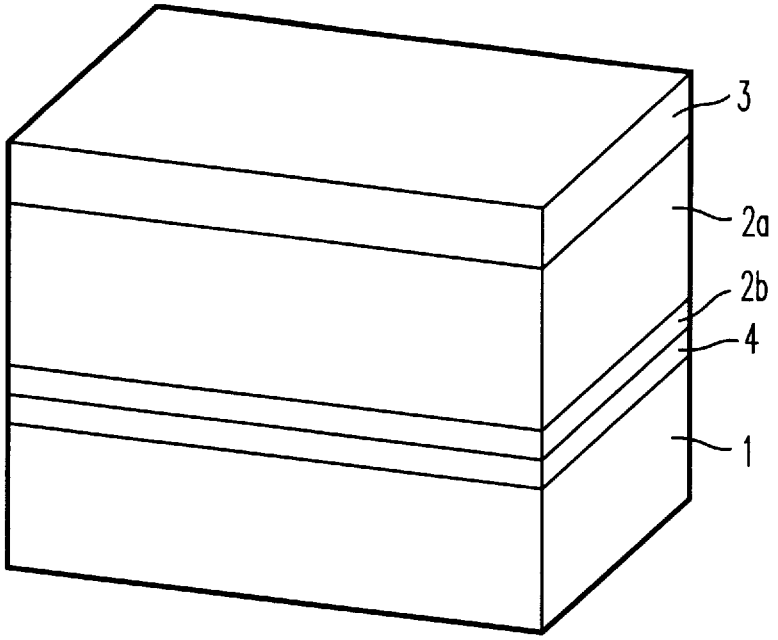
Figure 4:
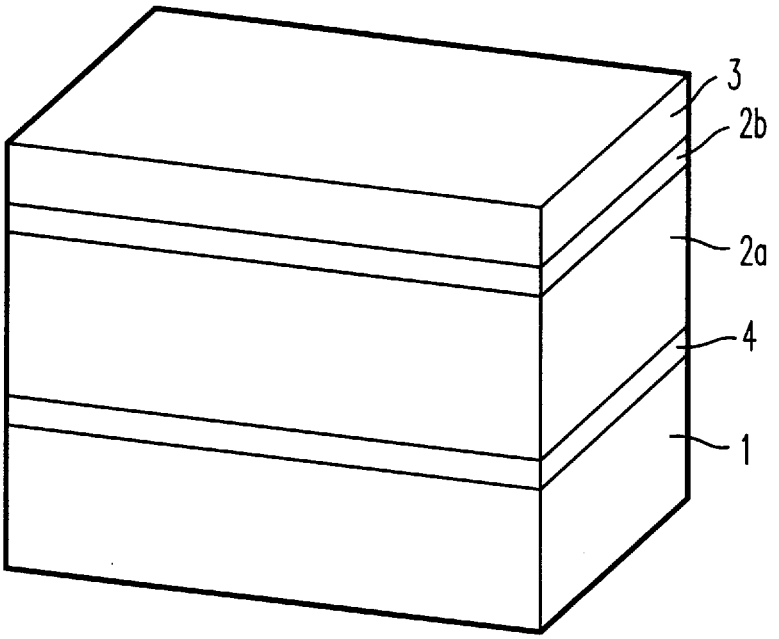

Illustrated in FIGS. 2–4 are partial cross sectional views of other examples of the electrophotographic photoconductor of the present invention.

Illustrated in FIG. 2 is a conductive supporting substrate 1, an undercoat layer 4 disposed thereon, a photoconductive layer 2 disposed further thereon and a surface protective layer 3 disposed on the photoconductive layer.

Illustrated in FIG. 3 is a photoconductor, comprising the same layered structure as in FIG. 2 provided that the photoconductive layer 2 is composed of a charge generation layer 2*b* and a charge transport layer 2*a* overlaid on the charge generation layer 2*b*. This photoconductive layer is referred to as a functionally separated-type photoconductive layer.

Illustrated in FIG. 4 is a photoconductor of the same layered structure as in FIG.3 provided that the charge generation layer 2*b* and the charge transport layer 2*a* are disposed in the reversed order in the photoconductor layer 2.

The layered structure of the photographic photoconductor of the present invention is not limited to the above layered structures, but may be modified in any manner as long as a photoconductive layer is provided on a conductive supporting substrate and a photoconductive layer is protected by a surface protective layer.

As materials for the conductive supporting substrate in the present invention, various conducting materials or insulating materials which are rendered conductive by treatment can be employed. Examples of these materials include metals, such as aluminum, iron, copper, gold and alloys thereof, and insulating substrates, such as polyester, poly-carbonate, polyimide and glass, provided with a conductive film of, for example, aluminum, silver, gold, $In_2O_3$ or $SnO_2$, or paper treated to be conductive.

The substrate may have any configuration desired and useful for its intended purpose, such as, for example, a plate, a cylindrical drum or an endless flexible belt.

The undercoat layer 4, is provided between the conductive supporting substrate 1 and the photoconductive layer 2 in order to improve the electrographic characteristics of the photoconductor and the adhesion of the photoconductive layer with the supporting substrate.

Suitable materials for the undercoat layer in the present invention include inorganic materials, such as $SiO_2$ $Al_2O_3$, a silane coupling agent, a titanium coupling agent, and a chromium coupling agent; and binder agents with sufficient adhesion, such as polyamide resin, alcohol-soluble polyamide resin, water-soluble polyvinyl butyral, polyvinyl butyral, and polyvinyl alcohol.

In addition, composite materials comprising any of the above-mentioned binder agents with appropriate adhesion and materials such as ZnO, $TiO_2$ or ZnS, which are dispersed in the binder agent, can be used as the undercoat layer material.

For the formation of the undercoat layer 4, sputtering or vacuum deposition can be used for any of the above-mentioned inorganic materials, and any conventional coating methods can be utilized for the organic materials.

The thickness of the undercoat layer is preferably less than or equal to 5 microns.

As the photoconductive layer, which is provided directly on the above-mentioned conductive supporting substrate 1 or on the undercoat layer 4 previously disposed on the conductive supporting substrate 1, either a Se-based or an organic photoconductor-based photoconductive layer may be used. Furthermore, with respect to the structure of the photoconductive layer, either a single layer type or a functionally separated type of photoconductor layer may be used.

Specific examples of a single layer organic photoconductor layer include (1) a coated layer comprising a photoconductive powder of dye-sensitized zinc oxide, titanium oxide or zinc sulfate, amorphous silicon powder, a squarylic salt pigment, a phthalocyanine pigment, an azulenium salt pigment, or an azo pigment, which are also employed, if necessary, in combination with a binder agent and/or an electron-donating compound and (2) a layer comprising an eutectic compound of a pyrylium based dye and a bisphenol A based polycarbonate with an electron donating compound.

Suitable binder resins for use in the single layer organic photoconductor layer, include the same binder resins as used in functionally separated type photoconductor layers, which will be described later.

The thickness of the single layer photoconductor layer is preferably from 5 to 30 microns.

One embodiment of a functionally separated type photoconductor layer comprises a charge generation layer and a charge transport layer. The charge generation layer (CGL), in which the latent electrostatic images are formed by light exposure, can be a layer comprising an inorganic photoconductive powder of crystalline selenium, arsenic selenide or an organic dye or pigment, any of them being dispersed or dissolved in a binder resin.

Examples of organic dyes or pigments used as a charge generation material include, but are not limited to:

C.I. Pigment Blue 25(C.I.21180),

C.I. Pigment Blue 41(C.I.21200),

C.I. Acid Red 52 (C.I.45100),

C.I. Basic Red 3(C.I.45210), phthalocyanine pigments having a porphyrin skeleton, azulenium salt pigment, squarylic salt pigment, azo pigments having a carboazole skeleton (Japanese Laid-Open Patent Application 53-95033), azo pigments having a styryl stilbene skeleton (Japanese Laid-Open Patent Application 53-138229), azo pigments having a triphenylamine skeleton (Japanese Laid-Open Patent Application 53-138229), azo pigments having a dibenzothiophene skeleton (Japanese Laid-Open Patent Application 54-21728), azo pigments having an oxadiazole skeleton (Japanese Laid-Open Patent Application 54-12742), azo pigments having a fluorenone skeleton (Japanese Laid-Open Patent Application 54-22834), azo pigments having a bisstilbene skeleton (Japanese Laid-Open Patent Application 54-17733), azo pigments having a distyryl oxadiazole skeleton (Japanese Laid-Open Patent Application 54-2129), azo pigments having a distyryl carbazole skeleton (Japanese Laid-Open Patent Application 54-17734), azo pigments having a carbazole skeleton (Japanese Laid-Open Patent Applications 57-195767 and 57-195768), phthalocyanine pigments such as C. I. Pigment Blue 16 (C.I. 74100), indigo pigments such as C.I. Vat Brown 5 (C.I. 73410) and C.I.Vat Dye (C.I.73030), and perylene pigments such as Algo Scarlet B (by Violet Co), and Indanthrene Scarlet R (by Bayer Co).

These charge generating materials may be used individually or in combination.

The charge generating materials are used in combination with binder resins to comprise the photoconductor layer. It is preferable that such a binder resin is employed in an amount of 0 to 100 parts by weight, more preferably in an amount of 0 to 50 parts by weight, to 100 parts by weight of the charge generating material.

Suitable binder resins used in combination with the above-mentioned organic dyes or pigments include adhesive and insulating resins, preferably condensation resins such as polyamide, polyurethane, polyester, epoxy resin, polycarbonate, and polyether; and polymers and copolymers such as polystyrene, polyacrylate, polymethacrylate, poly-N-vinylcarbazole, polyvinyl butyral, styrene-butadiene copolymer and styrene-acrylonitrile copolymer.

The charge generation layer can be formed by dispersing one or more charge generating materials, if necessary together with a binder resin, in a solvent, such as tetrahydrofuran, cyclohexanone, dioxane or dichloroethane, by the use of a grinding machine, such as a ball mill or a sand grinder, to prepare a coating composition, subsequently diluting properly, and coating the composition. The coating can be carried out by conventional methods, such as dipping, spray coating or bead coating. The charge generation layer 2*b* is preferably of a thickness from 0.01 to 5 microns, and more preferably is of a thickness of from 0.1 to 2 microns.

In the present invention, when particles of crystalline selenium or arsenic selenide are used as the charge generating material, the material is used in combination with an electron donating adhesive agent and/or an electron-donating organic compound.

Examples of such electron-donating materials include poly-N-vinylcarbazole, and derivatives thereof, such as substituted poly-N-vinyl carbazoles, wherein the substituents include groups such as halogen, lower ($C_{1-4}$)alkyl or amino; nitrogen-containing compounds and diarylmethane compounds such as poly(vinylpyrene), oxadiazole, pyrazoline, hydrazone, diarylmethane, α-phenylstilbene, and triphenylamine.

Of these compounds, poly-N-vinylcarbazole and derivatives thereof are particularly preferred. These compounds can be used singly or in combination, although when these compounds are used in combination, it is preferable to add the electron-donating compounds to poly-N-vinylcarbazole or its derivative.

It is preferred that the inorganic charge generating materials are included in the charge generation layer in an amount of 30 to 90 wt % of the total weight of the charge generation layer. Also, it is preferred that the charge generation layer comprising such an inorganic charge generating material have a thickness of from 0.2 to 5 microns.

The charge transport layer, 2*a*, has the function of retaining static charge, transporting charges generated by light exposure and subsequently separated in the layer, and combining the retained electric charges with the charges generated in the charge generation layer 2*b*.

It is requisite for the charge transport layer 2*a* to have (a) a high electric resistivity for retaining electric charges, and (b) a small dielectric constant and large charge mobility for attaining high surface potential by the retained electric charges.

In order to meet these requirements, the charge transport layer is composed of a charge transport material and, if necessary, a binder resin. The charge transport layer can be formed by dissolving or dispersing these components in an appropriate solvent to prepare a coating composition, then coating and drying the composition.

There are generally two kinds of charge transporting materials, positive-hole transporting materials and electron transporting materials.

Specific examples of the positive-hole transporting materials include electron-donating materials, such as, poly-N-vinylcarbazole and its derivatives, poly-γ-carbazolyl ethyl glutamate and its derivatives, pyrene-formaldehyde condensates and its derivatives thereof, polyvinyl pyrene, polyvinyl phenanthrene, oxazole derivatives, oxadiazole derivatives, imidazole derivatives, triphenyl amine derivatives, 9-(p-diethylaminostyryl)-anthracene, 1,1-bis-(4-dibenzylaminophenyl)propane, styryl anthracene, styryl pyrazoline, phenylhydrazone and derivatives thereof, and o-phenylstilbene derivatives.

Specific examples of the electron transporting materials include electron accepting materials, such as, chloroanil, bromoanil, tetracyanoethylene, tetracyanoquinonedimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno(1,2-b) thiophene-4-one, and 1,3,7-trinitrodibenzothiophenone-5,5-dioxide.

These charge transporting materials can be used individually or in combination.

Suitable examples of binder resins useful in the charge transport layer include thermoplastic resins and thermosetting resins, such as polystyrene, styrene-acrylonitrile copolymer, styrene-butadiene copolymer, styrene-maleic anhydride copolymer, polyester, polyvinyl chloride, vinylchloride vinylacetate copolymer, polyvinyl acetate, polyvinylidene chloride, polyacrylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin, and alkyd resin.

Suitable examples of a solvent for forming the charge transport layer include tetrahydrofuran, dioxane, toluene, monochlorobenzene, dichloroethane, and methylene chloride.

The charge transport layer is preferably of a thickness of from about 5 to 100 microns.

One or more plasticizers and/or one or more leveling agents can be added to the charge transport layer, if desired. As the plasticizer for use in the charge transport layer, conventionally used plasticizers, such as, dibutyl phthalate, and dioctyl phthalate, can be employed as they are. It is preferable that such a plasticizer is used in an amount of from 0 to 30 parts by weight to 100 parts by weight of the binder resin.

As a leveling agent for use in the charge transport layer, silicone oils such as dimethyl silicone oil and methylphenyl silicone oil can be used. It is preferable that such a leveling agent is employed in an amount of 0 to 1 part by weight to 100 parts by weight of the binder resin.

On the conductive supporting substrate, the charge generation layer can be overlaid onto the charge transport layer, or vice versa.

In the present invention, a surface protective layer 3 formed on the surface of the electrophotographic photoconductor is provided, comprising a high hardness layer of hydrogenated diamond-like carbon or hydrogenated amorphous carbon, containing at least one additional element selected from the group consisting of nitrogen, fluorine, boron, phosphorus, chlorine, bromine and iodine, and having a Knoop hardness of more than or equal to 1000 kg/mm$^2$ in the outermost portion of the surface protective layer.

It is preferable that the high hardness surface protective layer has carbon-carbon bonds of sp' hybrid orbitals, the structure of which are similar to the carbon-carbon bonds of diamond. The layer is preferably of a thickness of from 1 to 3 microns. In that thickness range, properties such as anti-scratch, light transparency and electrophotographic sensitivity are considerably improved. In the surface protective layer the atomic ratio of total additional elements to carbon is smaller and, preferably, is zero (i.e. no additional elements are present) in close proximity to the photoconductive layer.

When the surface protective layer further comprises nitrogen, the atomic ratio of nitrogen to carbon, the N/C ratio, is preferably less than or equal to 0.005 in close proximity to the photoconductive layer. Likewise, when the surface protective layer further comprises fluorine, the atomic ratio of fluorine to carbon, the F/C ratio, is preferably less than or equal to 0.001 in close proximity to the photoconductive layer. The surface protective layer can be comprised of carbon with a graphite-like structure having sp' hybrid orbitals or an amorphous structure.

Furthermore, the layer may also be comprised of a single (i.e. non-stratified) layer comprising carbon containing the aforementioned additional elements wherein the ratio of the total additional elements to carbon is in a gradient along the direction of the layer thickness without any discrete change of the ratio.

The surface protective layer can be fabricated by the use of a hydrocarbon gas such as methane, ethane, ethylene, acetylene or the like as the main component, and a carrier gas such as $H_2$, Ar or the like.

As the materials for supplying the additional elements, any materials which can be vaporized under conditions of reduced pressure and/or heat can be used.

Suitable gases which can be used for supplying the additional elements include: $NH_3$ and $N_2$ for supplying nitrogen; $C_2F_6$ and $CH_3F$ for fluorine; $B_2H_6$ for boron; $PH_3$ for phosphorus; $CH_3Cl$, $CH_2Cl_2$, $CHCl_3$ and $CCl_4$ for chlorine; $CH_3Br$ for bromine; and $CH_3I$ for iodine, respectively.

As the gases for supplying a plurality of additional elements, $NF_3$, $BCl_3$, $BBr_3$, $BF_3$, $PF_3$, $PCl_3$ and the like can be used.

By the use of the above-mentioned gases, the surface protective layer can be fabricated by methods such as a plasma CVD method, a glow discharge decomposition method, a photo CVD method, or a sputtering method using a graphite target.

The methods for fabricating the surface protective layer are not limited to these methods, and a film deposition method has been disclosed in Japanese Laid-Open Patent Application No. 58-49609, which uses a plasma CVD method, taking advantage of concurrent sputtering effects and capable of fabricating a surface protective layer comprising carbon with excellent characteristics suitable for the surface protective layer.

In the plasma CVD method for forming the protective layer, it is unnecessary to heat the substrate for the protective layer deposition, and the layer can be formed at a temperature of about 150° C. or less. This method thus has an advantage over other methods of film deposition and a protective layer can be formed onto an organic photoconductor layer which has relatively low heat resistance.

The thickness of such a protective layer comprising carbon can be controlled, for instance, by adjusting the film deposition time.

Chemical composition of surface protective layers can be analyzed with conventional analytical methods, such as XPS, AES, and SIMS.

Having generally described this invention, a further understanding can be obtained by reference to certain specific examples which are provided herein for purposes of illustration only and are not intended to be limiting. In the description in the following examples, numerals are in weight ratio unless otherwise indicated.

EXAMPLES

Example 1

An electrophotographic photoconductor of the present invention was fabricated in accordance with steps and apparatus which follow.

Formation of undercoat layer

A mixture of the following components was prepared by dispersing for 12 hours in a ball mill to obtain a coating composition for an undercoat layer.

| | |
|---|---|
| $TiO_2$ Tipaque made by Ishihara Sangyou Co) | 1 |
| Polyamide resin (CM 8000 made by Toray Industries) | 1 |
| Methanol | 25 |

The composition was coated on a cylindrical aluminum supporting substrate of 80 mm in outer diameter and 340 mm in length, and dried to obtain an undercoat layer of a thickness of about 2 microns.

Formation of charge generation layer

A mixture of the following components was dispersed in a ball mill for 72 hours.

Trisazo pigment of the following formula:

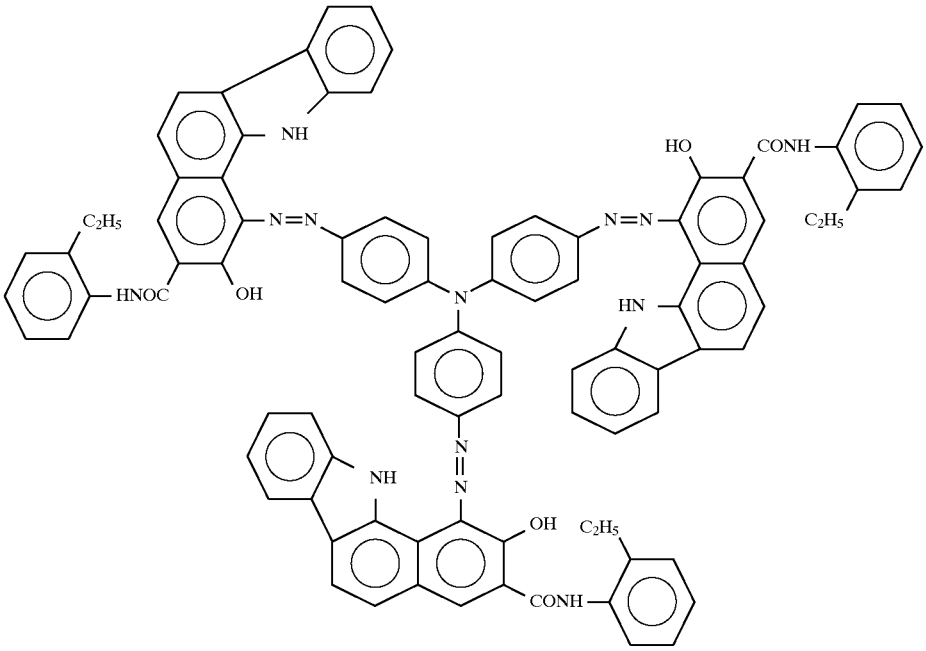

| | |
|---|---|
| Polyester resin (Vylon 200 made by Toyobo Co) | 12 |
| Cyclohexanone | 360 |

The thus prepared liquid was diluted with 500 parts by weight of a mixed solvent of cyclohexanone and methyl ethyl ketone with a mixing ratio of 1:1 by weight to obtain a charge generation layer coating composition.

The composition prepared as above was coated on the undercoat layer and then dried at 120° C. for 10 minutes to form a charge generation layer with a thickness of about 0.15 micron.

Formation of charge transport layer

A coating composition for a charge transport layer was prepared by dispersing the following components.

Charge transporting material of the following formula:

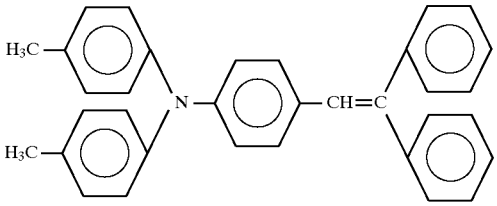

| | |
|---|---|
| Polycarbonate (Panlite C-1400 made by Teijin Chemical) | 10 |
| Tetrahydrofuran | 10 |
| Silicone oil (KF50 made by SinEtsu Chemical Co) | 80 |
| | 0.001 |

This solution was dip coated onto the charge generation layer, and then dried, to form a charge transport layer of a thickness of about 30 microns.

The above-noted charge generation layer, along with the charge transport layer and the undercoat layer, constitutes an organic photoconductor layer.

Figure 5:
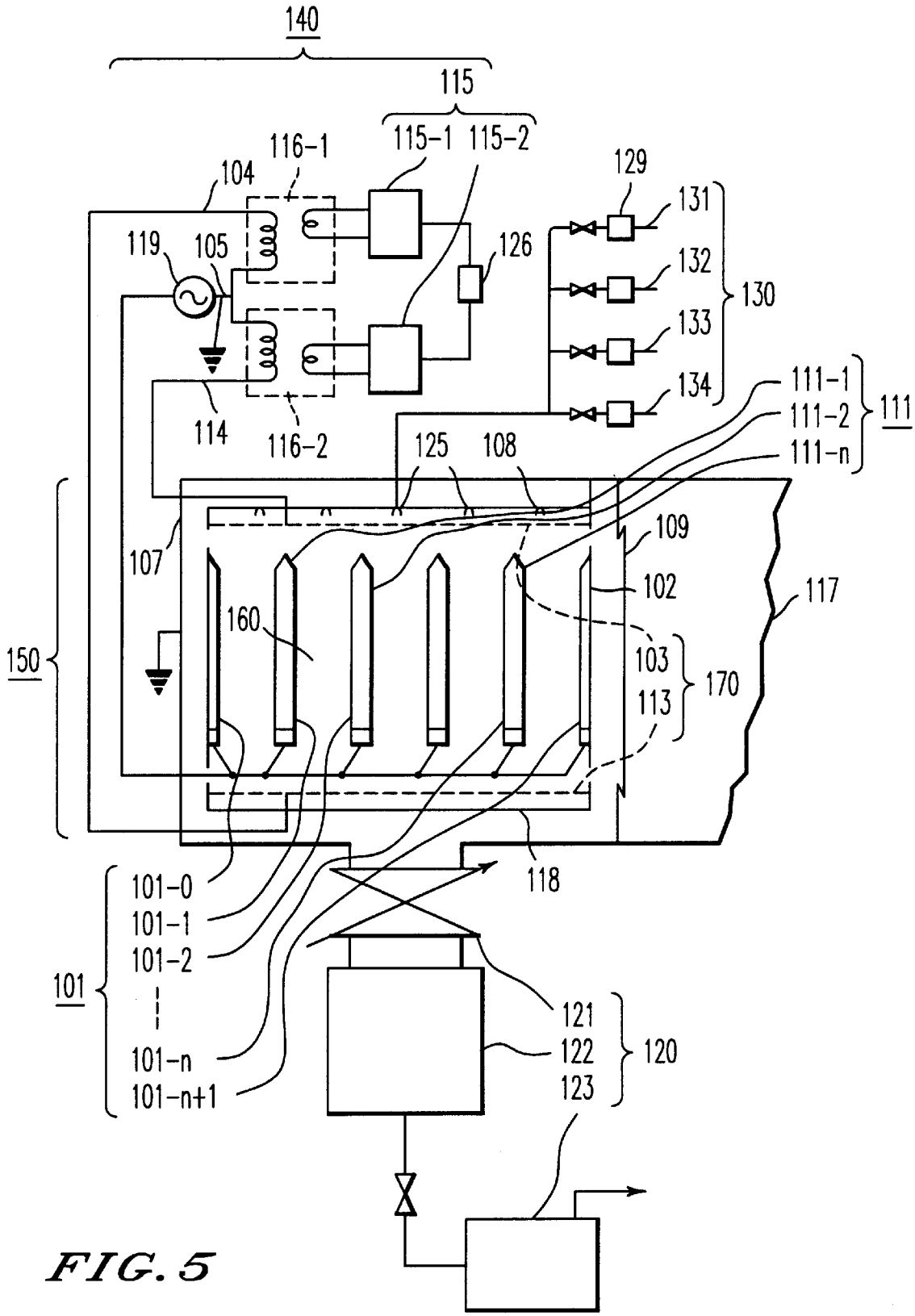
FIG. 5 is a block diagram of a specific example of a plasma CVD apparatus used for the fabrication of a protective layer comprising carbon in the present invention.
Figure 6:
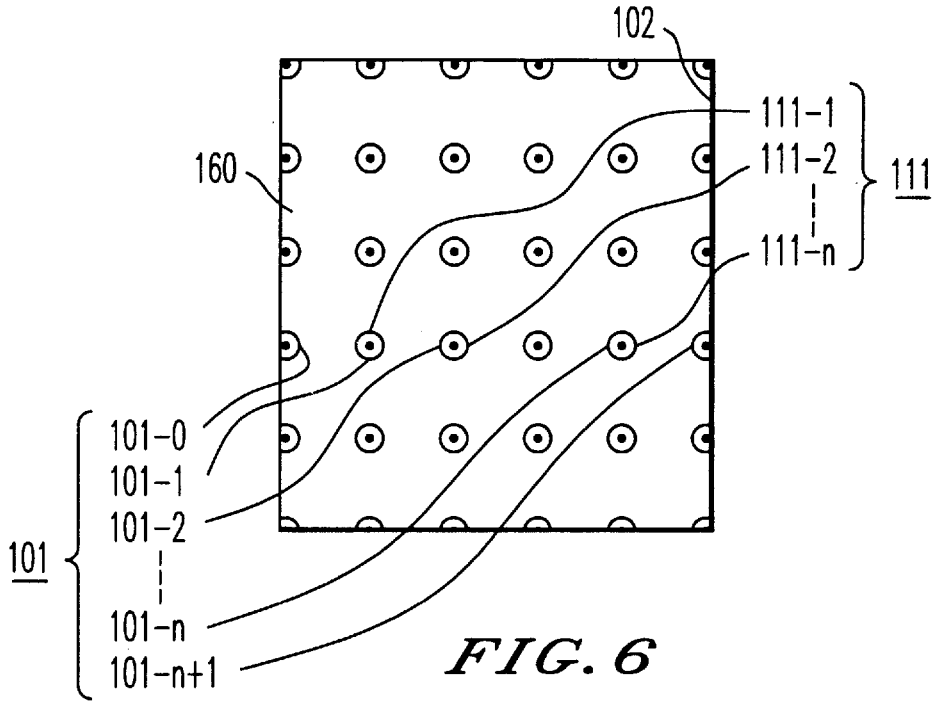
FIG. 6 is a plan view of an example of a frame structure for use in the plasma CVD apparatus shown in FIG. 5.
Figure 7:
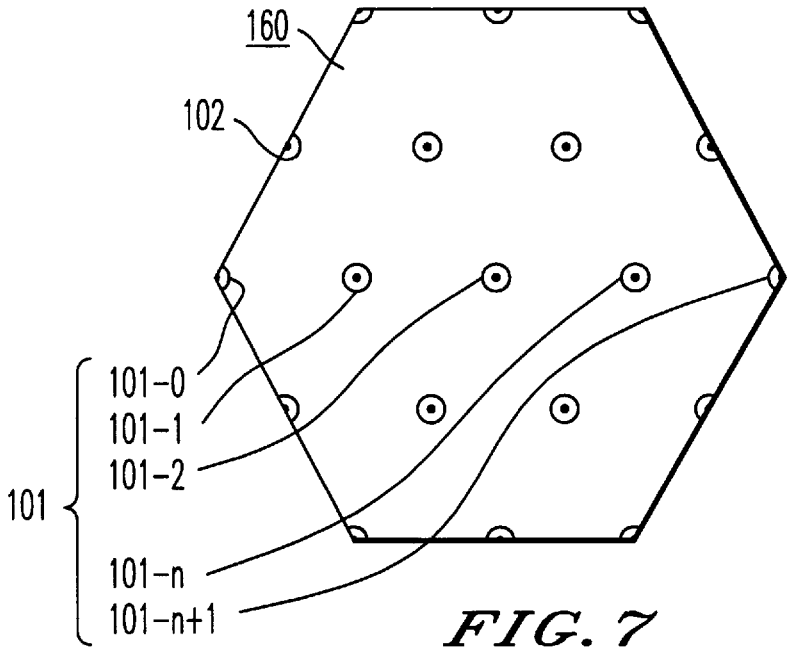
FIG. 7 is a plan view of another example of a frame structure for use in the plasma CVD apparatus shown in FIG. 5.

The layer of organic photoconductor fabricated as above was mounted in a plasma CVD apparatus as shown in FIGS. 5, 6 and 7, whereby a surface protective layer 3 comprising carbon was subsequently formed on the organic photoconductor layer.

As illustrated in FIG. 5, a plasma CVD apparatus generally comprises a vacuum chamber 107 with a preparatory loading and unloading chamber 117 partitioned by a gate valve 121, evacuated to and/or maintained at an appropriate low pressure by an evacuation system 120 comprising a pressure adjustment valve 121, a turbo-molecular pump 122, and a rotary pump 123.

In the vacuum chamber 107, there is provided a reactor 150. The reactor 150 contains a frame structure 102 which is square-shaped or hexagon-shaped when viewed from the side of an electrode as shown in FIGS. 6 and 7, hoods 108, 118 which seal a top and a bottom portion thereof, and a pair of electrodes 103 and 113 which are made of a sheet of metal mesh, such as aluminum mesh, in an identical shape, and are disposed respectively covering each of the hoods 108 and 118 inside of the reactor.

The plasma CVD apparatus also comprises a gas feeding system 130 for introducing gases into the reactor 150, having gas lines from 131 to 134, which are connected to various gas pressure vessels and led to the chamber 150 through mass flow controls 129, and nozzles 125.

In the frame structure 102, supports 101 (101-1, 101-2, . . . , 101-n) mounted with the previously fabricated photoconductor layer are placed as shown in FIGS. 6 and 7. Each of these supports is disposed as a third electrode.

A pair of power sources 115 (115-1, 115-2) are provided for applying a first ac voltage to the electrodes 103 and 113. The frequency of the first ac voltage is in the range of from 1 to 100 MHz. The power sources 115 (115-1,115-2) are respectively connected to matching transformers 116-1, 116-2. The phases in these matching transformers are regulated by a phase regulator 126, so that the power can be supplied with the phase shifted by 180° or 0°. In other words, the power sources 115 (115-1, 115-2) are operable in either of a symmetrical or in-phase mode.

One end 104 of the matching transformer 116-1 and the other end 114 of the matching transformer 116-2 are respectively connected to each of the second electrodes 103,113. A midpoint 105 on the output side of the matching transformer 116-1, 116-2 is maintained at ground potential. In addition, a power source 119 is connected to the mid-point 105 and to a third electrode which is either the aforementioned supports 101(101-1, 101-2, . . . , 101-n) or a holder 102 electrically connected to the supports 101. This power source 119 is able to apply a second ac voltage across the mid-point 105 and the third electrode, resulting in improved film deposition capability.

The frequency of the second ac voltage is in the range of from 1 to 500 kHz. The output power from the first ac voltage applied to the first electrode and the second electrode is in a range of from 0.1 to 1 kW at a frequency of 13.56 MHz. The output power from the second ac voltage applied to the third electrode is about 100 W at a frequency of 150 kHz.

In this example, the surface protective layer 3 was deposited to have a two layer structure and a second layer, referred to as a second protective layer, was overlaid on the first layer or the first protective layer.

Reaction parameters and process conditions for the deposition of the protective layer are now described.

Formation of first protective layer

The first protective layer composed of hydrogenated amorphous carbon was deposited under the following conditions:

| | |
|---|---|
| Flow rate of $CH_4$ | 200 sccm |
| Reaction pressure | 0.01 torr |
| Output power from the first ac voltage | 100 W at 13.56 MHz |
| Bias voltage (dc component) | −100 v |
| Layer thickness | 0.15 microns |

The bias voltage (dc component) is a quantity related to the aforementioned second ac voltage applied between the mid-point 105 and the third electrode. Its dc component is herewith included as a characteristic parameter for the second ac voltage.

In addition to the process conditions, the thickness of the resulting layer is also included above.

Composition analysis by XPS was carried out for the first layer prepared as above. The results indicated that the layer contained carbon, oxygen and hydrogen, but not nitrogen.

Formation of second protective layer

The second protective layer composed of hydrogenated amorphous carbon and further including nitrogen was deposited under the following conditions:

| | |
|---|---|
| Flow rate of $CH_4$ | 90 sccm |
| Flow rate of $H_2$ | 210 sccm |
| Flow rate of $N_2$ | 45 sccm |
| Reaction pressure | 0.02 torr |
| Output power from the first ac voltage | 100 W at 13.56 MHz |
| Bias voltage (dc component) | −35 V |
| Layer thickness | 4 microns |
| Knoop hardness | 1200 kg/mm$^2$ |
| N/C ratio | 0.15 |

The thus fabricated second layer was subjected to composition analysis by XPS. The results indicated that the second layer contained carbon, oxygen, hydrogen and nitrogen, with the N/C ratio thereof being 0.15 as above-mentioned.

The electrophotographic photoconductor with the protective layer of the two layer structure fabricated as above was subsequently subjected to electrophotographic evaluation tests. The photoconductor was incorporated into a Ricoh Co digital copy apparatus commercially available as the IMAGIO 420V™ and produced 400,000 photocopies, wherein measurements of the initial photosensitivity thereof and inspection by visual observation were carried out concerning peeling of the surface protective layer off from the photoconductive layer and scratching on the surface of the photoconductor after the 400,000 copies. The results are shown in Table 1.

Example 2

An electrophotographic photoconductor was fabricated by repeating the procedure of Example 1, with the exception that the first protective layer was deposited under the following conditions:

| | |
|---|---|
| Flow rate of $CH_4$ | 200 sccm |
| Flow rate of $N_2$ | 20 sccm |
| Reaction pressure | 0.01 torr |
| Output power from the first ac voltage | 100 W at 13.56 MHz |
| Bias voltage (dc component) | −200 V |
| Layer thickness | 0.12 micron |
| N/C ratio | 0.008. |

Composition analysis by XPS was carried out for the first layer. The results of the analysis indicated that the layer contained carbon, oxygen, hydrogen and nitrogen.

The thickness and the N/C ratio of the resulting first layer are included above in addition to the process conditions.

The photoconductor fabricated as above was subsequently subjected to electrophotographic evaluation tests by repeating the procedure of Example 1. The results of the tests are shown in Table 1.

Example 3

An electrophotographic photoconductor was fabricated by repeating the procedure of Example 1, with the exception that the second protective layer was deposited under the following conditions:

| | |
|---|---|
| Flow rate of $CH_4$ | 100 sccm |
| Flow rate of $H_2$ | 200 sccm |
| Flow rate of $C_6F_6$ | 50 sccm |
| Reaction pressure | 0.01 torr |
| Output power from the first ac voltage | 100 W at 13.56 MHz |
| Bias voltage (dc component) | −40 V |
| Layer thickness | 0.15 micron |
| Knoop hardness | 1100 kg/mm$^2$ |
| F/C ratio | 0.05 |

Composition analysis by XPS was carried out for the second layer. The results of the analysis indicated that the layer contained carbon, oxygen, hydrogen and fluorine.

The photoconductor fabricated as above was subsequently subjected to the similar electrophotographic evaluation tests by repeating the procedure of Example 1. The results of the tests are shown in Table 1.

Example 4

An electrophotographic photoconductor was fabricated by repeating the procedure of Example 1, with the exception that a second protective layer was deposited under the following conditions:

| | |
|---|---|
| Flow rate of $CH_4$ | 90 sccm |
| Flow rate of $H_2$ | 200 sccm |
| Flow rate of $B_6H_6$ | 40 sccm |
| Reaction pressure | 0.01 torr |
| Output power from the first ac voltage | 100 W at 13.56 MHz |
| Bias voltage (dc component) | −30 V |
| Layer thickness | 0.15 micron |
| Knoop hardness | 1050 kg/mm$^2$ |

The thus fabricated photoconductor layer was subjected to composition analysis by XPS. The results indicated that the layer contained carbon, oxygen, hydrogen and boron.

The photoconductor fabricated as above was subsequently subjected to the similar electrophotographic evaluation tests as Example 1. The results of the tests are shown in Table 1.

Example 5

An electrophotographic photoconductor was fabricated by repeating the procedure of Example 1, with the exception that a first protective layer was deposited under the following conditions:

| | |
|---|---|
| Flow rate of $CH_4$ | 200 sccm |
| Flow rate of $N_2$ | 5 sccm |
| Reaction pressure | 0.01 torr |
| Output power from the first ac voltage | 100 W at 13.56 MHz |
| Bias voltage (dc component) | −200 V |
| Layer thickness | 0.12 micron |
| N/C ratio | 0.002 |

The photoconductor layer fabricated as above was subjected to composition analysis by XPS. The results of the analysis indicated that the layer contained carbon, oxygen, hydrogen and nitrogen.

The photoconductor was subsequently subjected to the similar electrophotographic evaluation tests as Example 1. The results of the tests are shown in Table 1.

Example 6

An electrophotographic photoconductor fabrication and electrophotographic evaluation tests for the photoconductor were carried out by repeating the procedure of Example 1, with the exception that the second protective layer was deposited to have a thickness of 0.8 microns.

The results of the tests are shown in Table 1.

Example 7

An electrophotographic photoconductor fabrication and electrophotographic evaluation tests for the photoconductor were carried out in a similar manner to Example 1, with the exception that the second protective layer was deposited to have a thickness of 1.8 microns.

The results of the tests are shown in Table 1.

Example 8

An electrophotographic photoconductor was fabricated by repeating the procedure of Example 1, with the exception that the protective layer disposed on the photoconductive layer had a three layer structure and each layer thereof was deposited under the following conditions:

| First protective layer formation | |
|---|---|
| Flow rate of $C_2H_4$ | 200 sccm |
| Reaction pressure | 0.01 torr |
| Output power from the first ac voltage | 100 W at 13.56 MHz |
| Bias voltage (dc component) | −200 V |
| Layer thickness | 0.12 microns |

The thus prepared first protective layer was subjected to composition analysis by XPS. The results indicated that the film contained carbon, oxygen and hydrogen.

| Second protective layer formation | |
|---|---|
| Flow rate of $C_2H_4$ | 90 sccm |
| Flow rate of $H_2$ | 210 sccm |
| Flow rate of $NF_3$ | 45 sccm |
| Reaction pressure | 0.02 torr |
| Output power from the first ac voltage | 100 W at 13.56 MHz |
| Bias voltage (dc component) | −20 V |
| Layer thickness | 1.9 microns |

The thus prepared second protective layer was subjected to composition analysis by XPS. The results indicated that the film contained carbon, oxygen, hydrogen, nitrogen and fluorine.

| Third protective layer formation | |
|---|---|
| Flow rate of $C_2H_4$ | 90 sccm |
| Flow rate of $H_2$ | 210 sccm |
| Flow rate of $NF_3$ | 45 sccm |
| Reaction pressure | 0.02 torr |
| Output power from the first ac voltage | 100 W at 13.56 MHz |
| Bias voltage (dc component) | −100 V |
| Layer thickness | 0.2 microns |
| Knoop hardness | 1300 kg/mm$^2$ |

The thus prepared third protective layer was subjected to composition analysis by XPS. The results indicated that the layer contained carbon, oxygen, hydrogen, nitrogen and fluorine.

The results of the electrographic evaluation tests of the photoconductor is shown in Table 1.

Example 9

An electrophotographic photoconductor was fabricated by repeating the procedure of Example 1, with the exception that the deposition of the first and second protective layers were carried out under the following conditions:

| First protective layer formation | |
|---|---|
| Flow rate of $CH_4$ | 250 sccm |
| Flow rate of $C_6F_6$ | 20 sccm |
| Reaction pressure | 0.01 torr |
| Output power from the first ac voltage | 100 W at 13.56 MHz |
| Bias voltage (dc component) | −200 V |
| Layer thickness | 0.12 micron |
| F/C ratio | 0.002 |

The thus prepared first protective layer was subjected to composition analysis by XPS. The results of the analysis indicated that the film contained carbon, oxygen, hydrogen and fluorine.

| Second protective layer formation | |
|---|---|
| Flow rate of $CH_4$ | 100 sccm |
| Flow rate of $H_2$ | 200 sccm |
| Flow rate of $C_6F_6$ | 50 sccm |
| Reaction pressure | 0.02 torr |
| Output power from the first ac voltage | 100 W at 13.56 MHz |
| Bias voltage (dc component) | −50 V |
| Layer thickness | 4 microns |
| Knoop hardness | 1200 kg/mm$^2$ |
| F/C ratio | 0.05 |

The thus prepared second protective layer was subjected to composition analysis by XPS. The results of the analysis indicated that the film contained carbon, hydrogen and fluorine.

The results of the evaluation tests for the photoconductor are shown in Table 1.

Example 10

An electrophotographic photoconductor was fabricated by repeating the procedure of Example 9, with the exception that a first protective layer was deposited under the following conditions:

| First protective layer formation | |
|---|---|
| Flow rate of $CH_4$ | 250 sccm |
| Flow rate of $C_6F_6$ | 5 sccm |
| Reaction pressure | 0.01 torr |
| Output power from the first ac voltage | 100 W at 13.56 MHz |
| Bias voltage (dc component) | −200 V |
| Layer thickness | 0.12 micron |
| F/C ratio | 0.0005 |

The thus prepared first protective layer was subjected to composition analysis by XPS. The results of the analysis indicated that the film contained carbon, oxygen, hydrogen and fluorine.

The results of the evaluation tests for the photoconductor are shown in Table 1.

Comparative Example 1

An electrophotographic photoconductor fabrication and electrophotographic evaluation tests for the photoconductor were carried out in a similar manner to Example 1, with the exception that a second protective layer was not provided and that the first protective layer was deposited to have a thickness of 4 microns.

The results of the tests are shown in Table 1.

Comparative Example 2

An electrophotographic photoconductor fabrication and electrophotographic evaluation tests for the photoconductor were carried out in a similar manner to Example 1, with the exception that the first protective layer was not provided.

The results of the tests are shown in Table 1.

Comparative Example 3

An electrophotographic photoconductor fabrication and electrophotographic evaluation tests for the photoconductor were carried out in a similar manner to Example 1, with the exception that the first and second protective layers were deposited under the following conditions:

| First protective layer formation | |
|---|---|
| Flow rate of $CH_4$ | 90 sccm |
| Flow rate of $H_2$ | 210 sccm |
| Flow rate of $N_2$ | 45 sccm |
| Reaction pressure | 0.02 torr |
| Output power from the first ac voltage | 100 W at 13.56 MHz |
| Bias voltage (dc component) | −35 V |
| Film thickness | 0.14 microns |
| N/C ratio | 0.15 |

The resulting first protective layer was subjected to composition analysis by XPS. The results indicated that the film contained carbon, oxygen, hydrogen and nitrogen.

| Second protective layer formation | |
|---|---|
| Flow rate of $CH_4$ | 200 sccm |
| Reaction pressure | 0.01 torr |
| Output power from the first ac voltage | 100 W at 13.56 MHz |
| Bias voltage (dc component) | −100 V |
| Layer thickness | 4 microns |
| Knoop hardness | 2000 kg/mm$^2$ |

The thus prepared second protective layer was subjected to composition analysis by XPS. The results of the analysis indicated that the film contained carbon, oxygen and hydrogen, and nitrogen was not included in the layer.

The results of the evaluation tests for the thus photoconductor are shown in Table 1.

Comparative Example 4

An electrophotographic photoconductor fabrication and electrophotographic evaluation tests for the photoconductor were carried out in a similar manner to Example 1, with the exception that the first and second protective layers were deposited under the following conditions:

| First protective layer formation | |
|---|---|
| Flow rate of $CH_4$ | 200 sccm |
| Reaction pressure | 0.01 torr |
| Output power from the first ac voltage | 100 W at 13.56 MHz |
| Bias voltage (dc component) | −100 V |
| Layer thickness | 0.15 microns |

The resulting first protective layer was subjected to composition analysis by XPS. The results of the analysis indicated that the film contained carbon, oxygen and hydrogen and that nitrogen was not included in the layer.

| Second protective layer formation | |
|---|---|
| Flow rate of $CH_4$ | 90 sccm |
| Flow rate of $H_2$ | 210 sccm |
| Flow rate of $N_2$ | 45 sccm |
| Reaction pressure | 0.03 torr |
| Output power from the first ac voltage | 100 W at 13.56 MHz |
| Bias voltage (dc component) | −5 V |
| Layer thickness | 4 microns |
| Knoop hardness | 500 kg/mm$^2$ |
| N/C ratio | 0.15 |

The thus prepared second protective layer was subjected to composition analysis by XPS. The results indicated that the film contained carbon, oxygen, hydrogen and nitrogen.

The results of the evaluation tests for of the photoconductor are shown in Table 1.

Comparative Example 5

An electrophotographic photoconductor fabrication and electrophotographic evaluation tests for the photoconductor were carried out in a similar manner to Example 1, with the exception that a first protective layer was deposited under the following conditions:

| First protective layer formation | |
|---|---|
| Flow rate of $CH_4$ | 100 sccm |
| Flow rate of $H_2$ | 200 sccm |
| Flow rate of $B_2H_6$ | 40 sccm |
| Reaction pressure | 0.03 torr |
| Output power from the first ac voltage | 100 W at 13.56 MHz |
| Bias voltage (dc component) | −20 V |
| Layer thickness | 4 microns |
| Knoop hardness | 900 kg/mm$^2$ |

The resulting first protective layer was subjected to composition analysis by XPS. The results of the analysis indicated that the film contained carbon, hydrogen and fluorine.

The results of the evaluation tests for the photoconductor are shown in Table 1.

Comparative Example 6

An electrophotographic photoconductor fabrication and electrophotographic evaluation tests for the photoconductor were carried out in a similar manner to Example 1, with the exception that the second protective layer was deposited under the following conditions:

| Second protective layer formation | |
|---|---|
| Flow rate of $CH_4$ | 90 sccm |
| Flow rate of $H_2$ | 200 sccm |
| Flow rate of $B_2H_6$ | 40 sccm |
| Reaction pressure | 0.03 torr |
| Output power from the first ac voltage | 100 W at 13.56 MHz |
| Bias voltage (dc component) | −20 V |
| Layer thickness | 4 microns |
| Knoop hardness | 850 kg/mm$^2$ |

The resulting second protective layer was subjected to composition analysis by XPS. The results indicated that the film contained carbon, oxygen and boron.

The results of the evaluation tests for the photoconductor are shown in Table 1.

TABLE 1

| | Prior to tests Photosensitivity | After 400,000 copies | |
|---|---|---|---|
| | (luxsec) (*1) | Peeling (*2) | Scratching (*3) |
| EXAMPLE 1 | 2.06 | ○ | ○ |
| EXAMPLE 2 | 2.08 | Δ | ○ |
| EXAMPLE 3 | 1.98 | ○ | ○ |
| EXAMPLE 4 | 2.03 | ○ | ○ |
| EXAMPLE 5 | 1.95 | ○ | ○ |
| EXAMPLE 6 | 1.65 | ○ | Δ |
| EXAMPLE 7 | 1.82 | ○ | ○ |
| EXAMPLE 8 | 1.46 | ○ | ○ |
| EXAMPLE 9 | 2.06 | Δ | ○ |
| EXAMPLE 10 | 1.96 | ○ | ○ |
| COMPARATIVE EXAMPLE 1 | unmeasurable | ○ | ○ |
| COMPARATIVE EXAMPLE 2 | 2.51 | X | unmeasurable |
| COMPARATIVE EXAMPLE 3 | unmeasurable | ○ | ○ |
| COMPARATIVE EXAMPLE 4 | 1.91 | ○ | X |
| COMPARATIVE EXAMPLE 5 | 2.11 | ○ | X |
| COMPARATIVE EXAMPLE 6 | 2.07 | ○ | X |

(*1) A photoconductor was corona charged to an initial surface potential of 800 V and was then exposed to light until the surface potential thereof was decreased to 160 V, one fifth of the initial surface potential, and time in seconds required for this decrease of the surface potential was measured to obtain the value of photosensitivity for each photoconductor.
(*2) Peeling of the surface protective layer observed on the surface of the photoconductive layer.
○ None,
Δ minute peeling, and
X peeling on the entire surface.
(*3) Scratches observed on the surface of the photoconductor.
○ None,
Δ minute scratches, and
X scratches on the entire surface.
(*)Unmeasurable: The residual potential was too high to be measured.

This application is based on Japanese Patent Application 07-149502, filed with the Japanese Patent Office on May 24, 1995, the entire contents of which are hereby incorporated by reference.

Obviously, additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electrophotographic photoconductor, comprising an electrically conductive supporting substrate, a photoconductive layer disposed thereon, and a surface protective layer disposed on said photoconductive layer, wherein said surface protective layer comprises a hydrogenated diamond-like carbon or a hydrogenated amorphous carbon, and further comprises at least one additional element selected from the group consisting of nitrogen, fluorine, boron, phosphorus, chlorine, bromine and iodine, wherein said at least one additional element is present from a first concentration in a portion of a layer of said surface protective layer adjacent to said photoconductive layer to a second concentration in a remainder of a layer of said surface protection layer, wherein said first concentration is lower than said second concentration, and wherein said surface protective layer has a Knoop hardness of more than or equal to 1000 kg/mm$^2$ in an outermost layer of the surface protective layer.

2. The electrophotographic photoconductor of claim 1, wherein said at least one additional element comprises nitrogen, and wherein the concentration of nitrogen, expressed as an atomic ratio of nitrogen to carbon, the N/C ratio, is less than or equal to 0.005 in close proximity to said photoconductive layer.

3. The electrophotographic photoconductor of claim 1, wherein said at least one additional element comprises nitrogen and fluorine, and wherein the concentration of flourine, expressed as an atomic ratio of fluorine to carbon, the F/C ratio, is less than or equal to 0.001 in close proximity to said photoconductive layer.

4. The electrophotographic photoconductor of claim 1, wherein said surface protective layer has a thickness of from 1 to 3 microns.

5. The electrophotographic photoconductor of claim 2, wherein said surface protective layer has a thickness of from 1 to 3 microns.

6. The electrophotographic photoconductor of claim 3, wherein said surface protective layer has a thickness of from 1 to 3 microns.

7. The electrophotographic photoconductor of claim 1, further comprising an undercoat layer disposed between said conductive supporting substrate and said photoconductive layer.

8. The electrophotographic photoconductor of claim 1, wherein said photoconductive layer is a functionally separated multilayer photoconductor comprising a charge generation layer and a charge transport layer.

9. The electrophotographic photoconductor of claim 1, wherein said photoconductive layer is a single layer photoconductor.

10. A method of forming an electrophotographic photoconductor, comprising the steps of:

forming on a conductive supporting substrate, a photoconductor layer, and forming on said photoconductive layer a surface protective layer comprising a hydrogenated diamond-like carbon or a hydrogenated amorphous carbon, wherein said surface protective layer further comprises at least one additional element selected from the group consisting of nitrogen, fluorine, boron, phosphorus, chlorine, bromine and iodine, wherein said at least one additional element is present from a first concentration in a portion of a layer of said surface protective layer adjacent to said photoconductive layer to a second concentration in a remainder of a layer of said surface protective layer, wherein said first concentration is lower than said second concentration, and wherein said surface protective layer has a Knoop hardness of more than or equal to 1000 $kg/mm^2$ in an outermost layer of the surface protective layer.

11. The method of claim 10, wherein said at least one additional element comprises nitrogen, wherein the concentration of nitrogen, expressed as an atomic ratio of nitrogen to carbon, the N/C ratio, is less than or equal to 0.005 in close proximity to said photoconductive layer.

12. The method of claim 10, wherein said at least one additional element comprises nitrogen and fluorine, wherein the concentration of fluorine, expressed as an atomic ratio of fluorine to carbon, the F/C ratio, is less than or equal to 0.001 in close proximity to said photoconductive layer.

13. The method of claim 10, wherein said surface protective layer has a thickness of from 1 to 3 microns.

14. The method of claim 11, wherein said surface protective layer has a thickness of from 1 to 3 microns.

15. The method of claim 12, wherein said surface protective layer has a thickness of from 1 to 3 microns.

16. The method of claim 10, further comprising an undercoat layer disposed between said conductive supporting substrate and said photoconductive layer.

17. The method of claim 10, wherein said photoconductive layer is a functionally separated multilayer photoconductor comprising a charge generation layer and a charge transport layer.

18. The method of claim 10, wherein said photoconductive layer is a single layer photoconductor.

* * * * *

UNITED STATES PATENT AND TRADEMARK OFFICE

CERTIFICATE OF CORRECTION

PATENT NO. : 5,840,455

DATED : NOVEMBER 24, 1998

INVENTOR(S): HIROSHI IKUNO ET AL

It is certified that an error appears in the above-identified patent and that said Letters Patent is hereby corrected as shown below:

On the title page, [*] Notice, second paragraph, line 3, "5,525,477" should read

--5,525,447--.

Signed and Sealed this

Third Day of April, 2001

*Attest:*

NICHOLAS P. GODICI

*Attesting Officer*

*Acting Director of the United States Patent and Trademark Office*